United States Patent [19]

Foley

[11] Patent Number: 4,541,594

[45] Date of Patent: Sep. 17, 1985

[54] TAKEOFF AND LANDING PLATFORM FOR V/STOL AIRPLANE

[75] Inventor: William H. Foley, Arlington, Tex.

[73] Assignee: General Dynamics Corporation, Fort Worth, Tex.

[21] Appl. No.: 460,599

[22] Filed: Jan. 24, 1983

Related U.S. Application Data

[63] Continuation of Ser. No. 218,983, Dec. 22, 1980, abandoned.

[51] Int. Cl.[4] ..... B64F 1/00

[52] U.S. Cl. ..... 244/114 B; 244/110 E

[58] Field of Search ..... 244/114 R, 114 B, 110 E, 244/63; 181/210, 218

[56] References Cited

U.S. PATENT DOCUMENTS

| | | | |
|---|---|---|---|
| 3,087,693 | 4/1963 | Nicholson et al. | 244/114 B |
| 3,436,036 | 4/1969 | Madelung | 244/114 B |

FOREIGN PATENT DOCUMENTS

| | | | |
|---|---|---|---|
| 1079467 | 4/1960 | Fed. Rep. of Germany | 244/114 B |
| 1100476 | 2/1961 | Fed. Rep. of Germany | 244/114 B |
| 1531538 | 4/1970 | Fed. Rep. of Germany | 244/114 B |
| 886204 | 1/1962 | United Kingdom | 244/114 B |

*Primary Examiner*—Trygve M. Blix
*Assistant Examiner*—Rodney Corl
*Attorney, Agent, or Firm*—James E. Bradley; Charles E. Schurman

[57] ABSTRACT

A takeoff and landing platform for V/STOL aircraft has features to reduce ground effect. The platform has a plurality of vanes mounted above a flat horizontal surface. Each of the vanes is curved to turn the jet stream from the vertical. The upper edges of all the vanes lie in a plane that is parallel with the horizontal surface. This plane is located at a distance from the horizontal surface that is about 0.5 to about 2.0 times the engine nozzle diameter at takeoff and landing of the type aircraft that use the platform.

11 Claims, 3 Drawing Figures

TAKEOFF AND LANDING PLATFORM FOR V/STOL AIRPLANE

CROSS REFERENCE TO RELATED APPLICATION

This is a continuation of Ser. No. 218,983 filed Dec. 22, 1980 now abandoned.

BACKGROUND OF THE INVENTION

This invention relates in general to takeoff and landing platforms for V/STOL airplanes, for reducing undesirable ground effect.

Vertical and short takeoff and landing airplanes are known as "V/STOL" airplanes. Normally, a V/STOL airplane has jet engines with nozzles that will deflect downwardly for takeoff and landing. A V/STOL airplane experiences undesirable ground effect during the takeoff and landing. The hot high velocity jet exhaust gas streams striking the landing surface create a suckdown force, reducing lift. Another effect, known as "fountain", results in an upward force on the aircraft. The fountain can be disadvantageous, also, since the positioning of the fountain is difficult to control. Also, the hot, upwardly deflected gasses if ingested by the engine inlet(s) will reduce the efficiency of the engine(s). Consequently, it is normally desirable to minimize such ground effects.

Some prior art proposals employ blades or vanes in a platform mounted above the underlying horizontal surface or ground plane and positioned to intercept exhaust gases from the engine and turn them so they are discharged away from the plane. e.g., laterally. Some of these proposals are complex, requiring spring loaded check valves or locating the vanes higher than desired above the ground plane, e.g., for shipboard use. Others utilize relatively small platforms, one for each jet stream or have constructions requiring rather precise positioning of the aircraft with respect to the blades during takeoff and landing to properly direct the engine exhaust.

SUMMARY OF THE INVENTION

The apparatus of this invention consists of a single platform large enough to physically support a V/STOL airplane on its upper surface. The platform has a plurality of vanes of substantially uniform height adapted to be mounted in unobstructed relation above a flat horizontal surface. Each vane is curved to turn the jet from the vertical direction, causing the jet to sweep laterally outward beneath the vanes and above the flat surface. The top edges of the vanes all lie in a single plane that is parallel with the horizontal surface and located at a distance from the horizontal surface that is about 0.5 to about 2.0 times the engine nozzle diameter at takeoff and landing. Preferably this distance will be from about 0.5 to about 1.4 engine nozzle diameters with excellent results having been found when this distance is from about 0.5 to about 0.86 nozzle diameters. With this device, the ground effects are reduced to near zero. Also, the construction provides a low height installation above a horizontal base or gound plane (e.g. a deck) that permits the desired directional movement of the exhaust away from the airplane during takeoff and landing of a V/STOL airplane in any airplane azimuth orientation relative to the apparatus.

DESCRIPTION OF THE PREFERRED EMBODIMENTS

Figure 1:
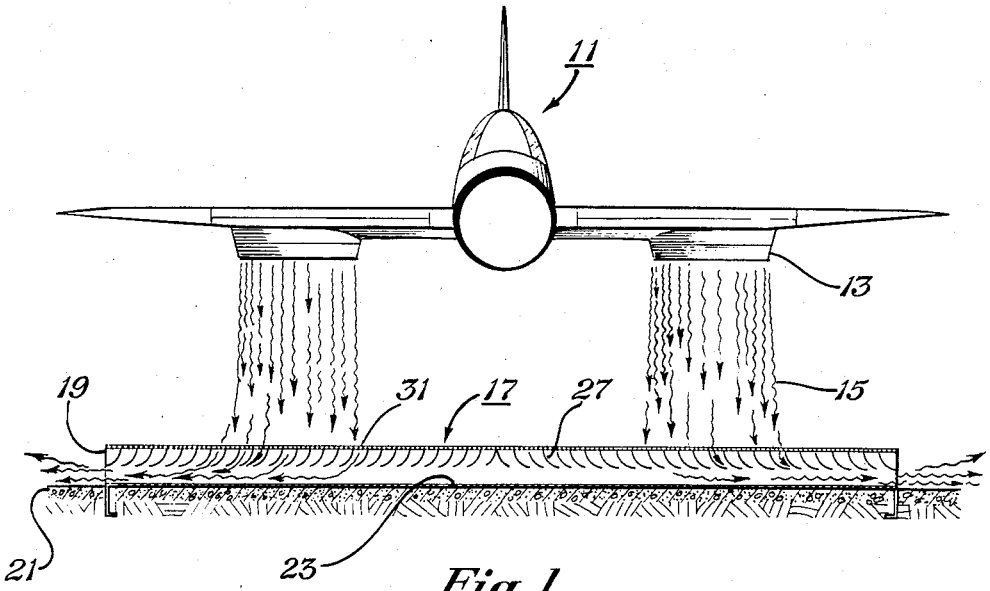
FIG. 1 is a vertical sectional view of a takeoff and landing platform constructed in accordance with this invention.

Referring to FIG. 1, a V/STOL aircraft 11 is schematically shown in a takeoff or landing position. The aircraft has two turbine engine nozzles 13, one on each wing. Each engine nozzle 13 will move vertically to direct propulsive jet streams 15 from a horizontal position for horizontal flight to a downwardly or vertical position for takeoff and landing.

The apparatus for reducing ground effect includes a platform 17. Platform 17 is mounted on columns or legs 19 that are fixed to a concrete pad 21 or a metal deck of a ship, forming a fixed ground plane. To reduce the detrimental effects of heat on the concrete pad 21, a steel plate 23 is located on top. Steel plate 23 is coextensive with platform 17 and is located in a horizontal plane.

Figure 2:
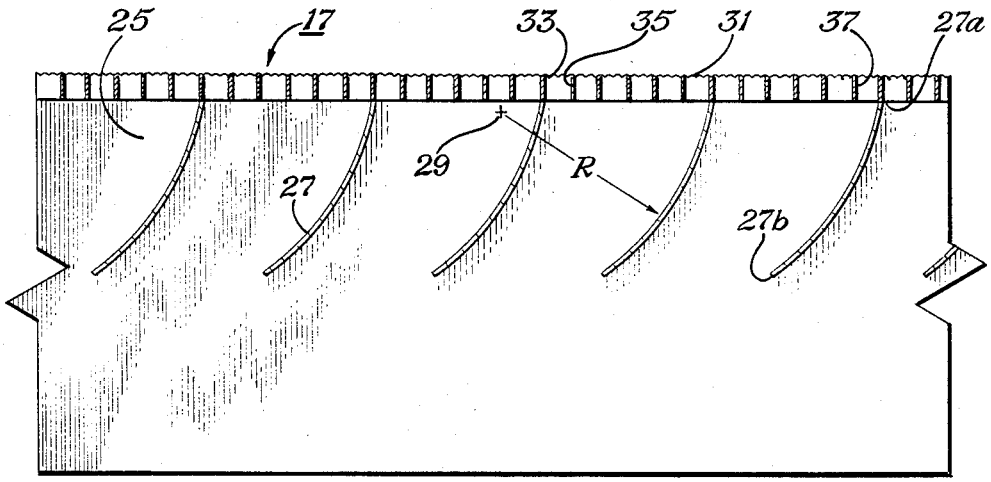
FIG. 2 is a partial, enlarged vertical sectional view of the platform of FIG. 1.
Figure 3:
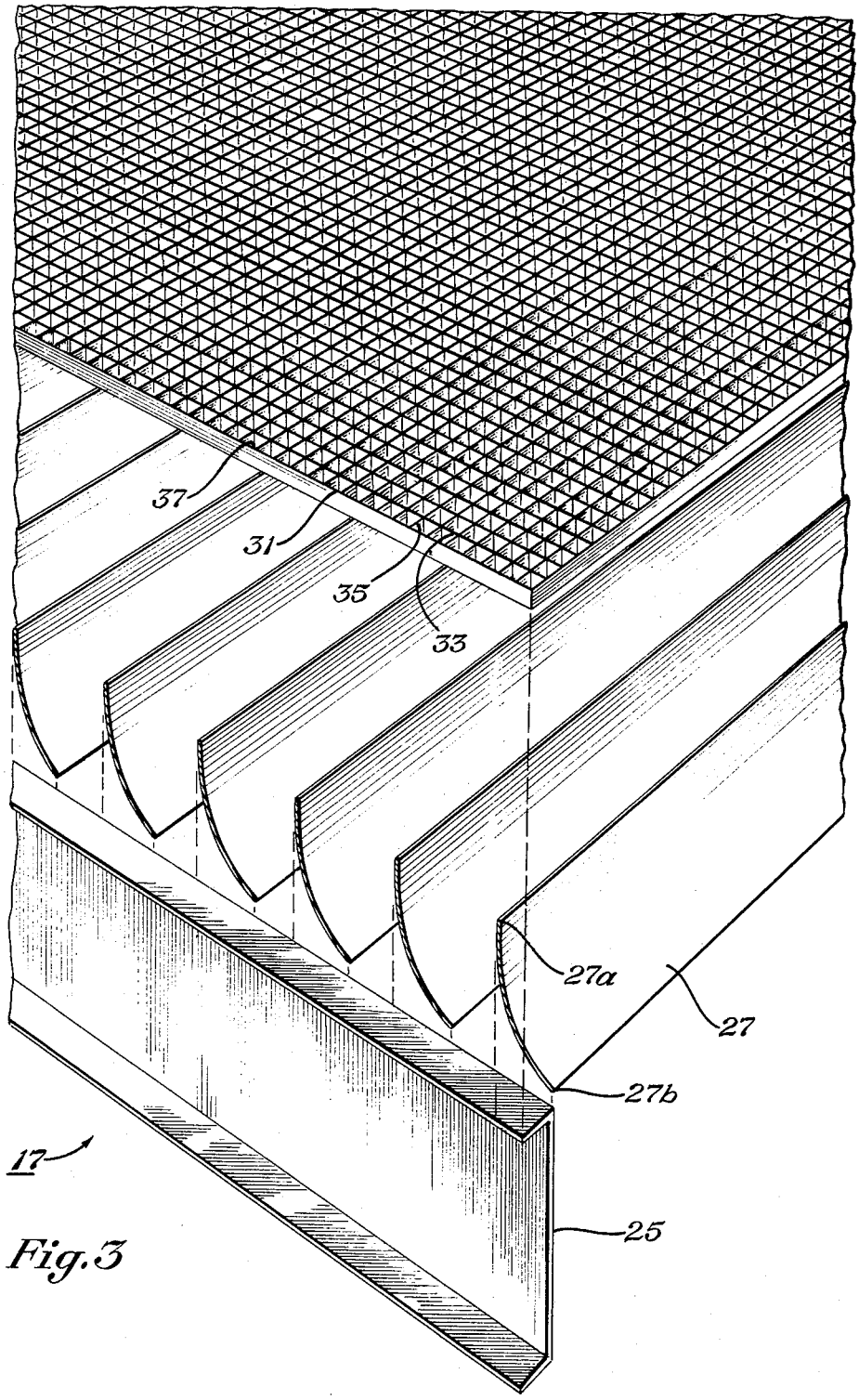
FIG. 3 is a partial, exploded, perspective view of the platform of FIG. 1.

Referring to FIG. 3, the front and back walls of the platform 17 comprise beams 25 that extend the width of the platform 17. The front wall 25 is not shown in FIGS. 1 and 2 in order to better illustrate the structure of platform 17. A plurality of vanes 27 are rigidly and stationarily mounted to and between the walls 25 in unobstructed relation above the flat horizontal surface 23. Vanes 27 are perpendicular to walls 25 and extend the full length of platform 17, over the full width thereof.

Each vane 27 is identical and curved when viewed in vertical cross-section as shown in FIG. 2. Each vane has an upper edge **27*a* and a lower edge 27*b*. Edges 27*a* and 27*b* are straight and parallel with each other. All of the upper edges 27*a* lie in a single plane that is parallel with the horizontal plane of steel plate 23. Similarly, all of the lower edges 27*b* lie in a single plane that is parallel to and above the horizontal plane of plate 23. All of the upper edges 27*a* are located at a selected distance above plate 23**.

This distance has been found to be highly efficient when between about 0.5 and about 0.86 times the diameter of the engine nozzle 13 of the aircraft 11 for which the platform 17 is designed. The distance could be greater than 0.86 times the engine nozzle 13 diameter such as 1.4 times, and it is feasible for the height to be at least 2.0 times the nozzle 13 diameter. For example, if the engine nozzle diameter is 18 inches, then the distance from upper edge **27*a* to plate 23 would be between 9 inches and 15½ inches, using the range of 0.5 to 0.86. Some engine nozzles 13 vary in diameter depending on flight position. For computing the distance to the top of vanes 27**, the diameter at the takeoff and landing should be used. The term "nozzle" as used herein means the point at which the jet stream leaves a chamber with greater than atmospheric total pressure and enters the atmosphere. In some aircraft, the outlet for a single engine is divided by vanes, thus could be considered a series of nozzles that combine to create a single jet stream. If the outlet is circular, the total diameter across the outlet should be considered the nozzle diameter.

The outlet might also be square or rectangular. If so, the smaller total distance across the outlet should be considered the nozzle diameter. The smaller distance in a rectangular nozzle is normally the longitudinal distance, measured along the length of the aircraft, when the nozzle is turned downward.

The spacing between vanes 27 is also important so as to turn the jet streams 15 efficiently. At least three of the vanes 27 should intersect the jet stream 15. Consequently, the distance between any two of the vanes 27 should be less than about one half the diameter of engine nozzle 13. For an 18 inch engine nozzle, a distance between vanes 27 of about 6 to 9 inches would be suitable. However, the distances between all of the vanes 27 are equal.

Vanes 27 have a uniform cross-sectional thickness, resulting in curved, preferably arcuate, parallel surfaces on both sides of each vane. This results in a concave configuration when viewed in vertical cross-section, as shown in FIGS. 2 and 3. Excellent results are obtained when the vane 27 curvature is the arc of a circle. The radius at which the vanes 27 are formed should be sufficient to turn the jet streams 15 so that the streams strike the steel plate 23 at a low angle, preferably tangential. However, the curvature should not be so great so as to drastically reduce the distance between the vanes 27 at their lower edges **27*b***.

For efficiency in manufacturing and also for the proper turning angle, a height defined by about a 50 to about 70 degree arc, has been found to be suitable for vanes 27. Excellent results have been obtained using a 60° arc. A radius that is less than the distance from upper edge **27*a* to plate 23 is preferred. Approximately the distance between vanes 27 is suitable as a radius, such as 6–9 inches as in the above-described example. The centerpoint 29 of the arc is selected so that the upper portion of each vane 27 will be tangent to a vertical plane. To accomplish this, centerpoint 29 should be about in the same horizontal plane as the upper edges 27*b* of the vanes. A radius R taken about centerpoint 29 for 60 degrees will result in a total vane 27 height that is about one half the distance from plate 23 to the upper edge 27*a*. Centerpoint 29 for a particular vane 27** will be located between the next two adjacent vanes.

With these parameters, the cross-sectional width of the jet stream 15, measured normal to the stream 15 as it discharges below two vanes 27, will be about 60% (percent) of the width between the two vanes at the top. Because of the far greater length of the vanes 27 than the nozzle 13 diameter, no appreciable restriction will occur.

In the preferred embodiment, all of the vanes 27 are mounted parallel with each other, but with half of the vanes having their concave sides facing toward the right, as shown in FIG. 1. The other half of the vanes 27 have their concave sides facing in the opposite direction, to the left as shown in FIG. 1. Where it is desired that all the engine exhaust be directed in a single direction, all of the vanes advantageously will be faced in the same direction.

Referring to FIGS. 2 and 3, a grid 31 is mounted on top of the vanes 27. Grid 31 is comprised of lateral members 33 that are perpendicular to vanes 26 and intersect members 35 at right angles. The longitudinal and lateral members 35 and 33 are flat strips oriented vertically, defining square apertures 37 for the passage of the jet streams 15. There are several longitudinal members 35 spaced parallel with and between each pair of vanes 27. The porosity, that is the ratio of the cross-sectional area of the total apertures 37 to the total grid surface area, should be greater than about 40%. In the preferred embodiment, there are at least five longitudinal members 35 between each two vanes 27. Apertures 37 are preferably square. The longitudinal and lateral members 35 and 33 preferably have serrated upper edges, as shown in FIG. 2, to provide a good gripping surface for personnel walking on the platform 17.

The platform 17 will be normally permanently mounted to a ship or to a concrete pad 21. Spaces exist between legs 19 on the two sides for discharging jet streams 15, so as substantially to prevent or to minimize engine injestion of exhaust gasses, and suckdown and fountain effects.

The platform length in the direction that the vanes 27 extend will be probably about 50% greater than its width. The width is greater than the distance between the outer edges of nozzles 13. A typical platform 17 would be about 30 feet wide and 50 feet long, or large enough to physically support an airplane on its upper surface, and intercept all of the downward flowing jets 15 when the airplane is in the landed position. For this size, the vanes advantageously are in the area of about 5 to above 7 inches in height, with their upper edges spaced above the ground plane about 9 to about 16 inches.

In operation, when taking off or landing, jet streams 15 are directed vertically downward. The streams 15 flow undeflected through the apertures 37 of grid 31, then are turned horizontally by the vanes 27 and underlying horizontal surface 23 to flow unobstructedly out the sides of platform 17. The flow exits the sides transverse to the lengths of the vanes 27. Normally, one stream 15 will discharge through the vanes 27 facing one side and the other stream 15 through the vanes 27 facing the opposite side. When the aircraft 11 contacts platform 17, the grid 31 supports the aircraft and provides an area for personnel to reach the aircraft.

The invention has significant advantages. Lift loss due to suckdown forces is held to a low percentage. Fountain is held to near zero. This minimizes the ground effects on the V/STOL aircraft for more efficient and safer takeoff and landing. The apparatus is simple in construction, having no moving parts. The large surface area of the platform reduces the requirements for precise maneuvering for landings. The positioning of the vanes and their curvature allows a low platform with a relatively light weight and size.

While the invention has been shown in only one of its forms, it should be apparent to those skilled in the art that it is not so limited but is susceptible to various changes and modifications without departing from the spirit of the invention.

I claim:

1. A take-off and landing platform means for supporting a powered V/STOL type airplane thereon above a ground plane in any azimuth position and effective for all such positions to direct airplane engine exhaust gases away from the airplane so as to prevent formation and rising of a fountain jet of exhaust gas beneath the airplane comprising:

a substantially unitary, horizontal support platform sized and adapted to support a powered V/STOL type airplane thereon in any azimuth position during landing, takeoff and when at rest;

support beam means for spacing the platform at a predetermined height above the ground plane for supporting the weight of a said V/STOL type airplane and said platform;

said platform comprising a gas flow directing floor portion of spaced-apart exhaust gas deflecting vanes connecting between and supported at their end portions by said support beam means;

said vanes fixedly arranged in a substantially horizontal plane and extending over substantially the entire area of said platform;

said vanes adapted to be positioned in substantially unobstructed relation to the landing area ground plane with their upper and lower edges spaced above said ground plane by said beam means;

said vanes curving in the vertical direction downward and outward toward the outer perimeter of the platform to direct substantially all of the engine exhaust gases impinging thereon away from beneath said airplane positioned over said platform by passing the gases via said curved vanes to below said platform then outward in substantially unobstructed flow beneath the flow directing vanes beyond the platform perimeter; and a horizontal open-work reticulated grid means overlying said vanes for walking thereon.

2. The platform means according to claim 1 wherein the perimeter of said platform bounds the landing area for touchdown of landing gear of the airplane.

3. The platform means according to claim 2 wherein the support beam means is attached at the perimeter of the platform.

4. The platform means according to claim 3 wherein each of said vanes is substantially equal in height from their lower edges to their upper edges.

5. A platform for take-off, landing, and support of a V/STOL airplane in any azimuth position above the ground plane supporting the platform to control ground effect produced by a propulsive jet exhaust therefrom comprising:

a plurality of jet exhaust directing vanes having upper and lower edges and forming a floor of vanes extending substantially continuously between opposite sides of said platform for supporting the weight of the airplane, in any azimuth position and for directing propulsive jet exhaust flow therefrom so as to control ground effect in any azimuth position of the airplane;

support means extending between the ground plane and the floor for maintaining the floor above the ground plane;

said vanes being secured in fixed positions to the support means and being curved in transverse cross-section;

said upper edges of the vanes lying in a single plane and said lower edges of the vanes being spaced directly above the ground plane to direct the exhaust to beneath the floor and over the ground plane so as to exit from beneath the platform substantially entirely transversely of said vanes;

said support means comprising portions forming wall means fixed at the ends of said vanes at opposite sides of said platform so as substantially to prevent the exhaust from flowing outward from beneath the platform in directions along and parallel to the vanes; and grid means mounted over the upper edges of the vanes for distributing weight of the airplane over at least some of said vanes and for walking thereon, the grid means having a plurality of apertures of smaller dimensions than the distance between the vanes.

6. The platform of claim 5 in which said support means provides for maintaining said floor stationarily fixed in position relative to the ground plane.

7. The platform of claim 5 in which at least some of said lower edges of said vanes define an underside plane of said floor which is positioned at substantially a uniform height above the ground plane over substantially the full extent of said floor.

8. The platform of claim 5 in which said floor is substantially unobstructed between the lower edges of the vanes and the ground plane.

9. The platform of claim 8 in which the distance from the ground plane to the plane containing the upper edges of the vanes is 0.5 to 2.0 times the largest engine nozzle diameter of an airplane thereover at take-off and landing.

10. The platform of claim 8 wherein each of said vanes is connected to said support means along substantially the entire curvature of said vane ends.

11. A platform for take-off, landing, and support of a V/STOL airplane in any azimuth position above the ground plane supporting the platform to control ground effect produced by a propulsive jet exhaust therefrom comprising:

a plurality of jet exhaust directing vanes having upper and lower edges and forming a floor of vanes between opposite sides of said platform for supporting the weight of the airplane in any azimuth position and for directing propulsive jet exhaust flow therefrom;

support means extending between the ground plane and the floor for maintaining the floor above the ground plane;

said vanes being secured in fixed positions to the support means and being curved in transverse cross-section;

said upper edges of the vanes lying in a single plane and said lower edges of the vanes being spaced directly above the ground plane to direct the exhaust to beneath the floor and over the ground plane;

said support means comprising portions forming wall means fixed at ends of said vanes at opposite sides of said platform so as to prevent the exhaust from flowing outward from beneath the platform in directions along and parallel to the vanes;

said wall means comprising solid walls extending from said floor to the ground plane; and grid means mounted over the upper edges of the vanes for distributing weight of the airplane over at least some of said vanes and for walking thereon, the grid means having a plurality of apertures of smaller dimensions than the distance between the vanes.

* * * * *